US007721478B2

(12) United States Patent
Withers et al.

(10) Patent No.: US 7,721,478 B2
(45) Date of Patent: May 25, 2010

(54) GUN BARREL AND METHOD OF FORMING

(75) Inventors: James C. Withers, Tucson, AZ (US); Lori A. Bracamonte, Tucson, AZ (US); Roger S. Storm, Tucson, AZ (US); Sion M. Pickard, Tucson, AZ (US); Raouf O. Loutfy, Tucson, AZ (US)

(73) Assignee: Materials & Electrochemical Research Corp., Tucson, AZ (US)

( * ) Notice: Subject to any disclaimer, the term of this patent is extended or adjusted under 35 U.S.C. 154(b) by 409 days.

(21) Appl. No.: 11/115,929

(22) Filed: Apr. 27, 2005

(65) Prior Publication Data

US 2005/0268517 A1 Dec. 8, 2005

(51) Int. Cl.
*F41A 21/02* (2006.01)

(52) U.S. Cl. ..... 42/76.02

(58) Field of Classification Search ..... 42/76.02, 42/78

See application file for complete search history.

(56) References Cited

U.S. PATENT DOCUMENTS

| | | | | |
|---|---|---|---|---|
| 4,138,512 | A | 2/1979 | Glaski | 427/237 |
| 4,401,729 | A | 8/1983 | Claussen et al. | 428/623 |
| 4,435,455 | A * | 3/1984 | Prewo et al. | 428/34.5 |
| 4,577,431 | A * | 3/1986 | Siemers et al. | 42/76.02 |
| 4,669,212 | A * | 6/1987 | Jackson et al. | 42/76.02 |
| 4,685,236 | A | 8/1987 | May | 42/76.02 |
| 4,822,759 | A | 4/1989 | Newkirk et al. | 501/127 |
| 5,125,179 | A | 6/1992 | Campbell et al. | 42/76.02 |
| 5,348,598 | A | 9/1994 | Vives et al. | 156/93 |
| 5,410,796 | A | 5/1995 | Weeks, Jr. | 29/419.1 |
| 5,855,828 | A * | 1/1999 | Tuffias et al. | 264/29.1 |
| 6,087,022 | A * | 7/2000 | Burris et al. | 428/610 |
| 7,153,465 | B1 * | 12/2006 | Schwab et al. | 264/430 |
| 2003/0154582 | A1 * | 8/2003 | Nakamura | 29/2.15 |
| 2004/0140292 | A1 * | 7/2004 | Kelley et al. | 219/76.13 |
| 2004/0209716 | A1 * | 10/2004 | Vacek et al. | 473/567 |
| 2004/0222571 | A1 * | 11/2004 | Steffier | 264/602 |
| 2008/0095942 | A1 * | 4/2008 | Sherwood et al. | 427/314 |

OTHER PUBLICATIONS

Official Action received in Applicants' corresponding EPO Patent Application Serial No. 05 740 334.7-1260.

* cited by examiner

*Primary Examiner*—Troy Chambers
(74) *Attorney, Agent, or Firm*—Hayes Soloway P.C.

(57) ABSTRACT

A fabrication technique is described for producing lighter weight and improved wear and erosion resistant gun barrels. The barrels are produced in an unconventional manner from the inside bore to the outside diameter of the barrel and combine a refractory metal, metal alloy, or ceramic composite inner liner with a metal matrix composite (MMC) or titanium or other suitable high strength, lightweight metal or metal alloy outer shell. A unique aspect of the invention is that there is a compositional gradation from the liner at the inside bore to the overwrap which extends to the outside diameter of the barrel. A process is also described to produce barrels with a refractory metal liner with improved wear and erosion resistance by depositing the refractory metal on the ID of a prefabricated barrel.

24 Claims, 4 Drawing Sheets

Mandrel CMC MMC

Mandrel CMC MMC

GUN BARREL AND METHOD OF FORMING

STATEMENT REGARDING FEDERALLY SPONSORED RESEARCH OR DEVELOPMENT

This invention was made with government support under DOD Contract Nos. DAAD19-02-C-0066 and W15QKN-04-C-1028 awarded by the Army and Contract No. M67854-03-C-1011 awarded by the Navy. The Government may have certain rights in the invention.

CROSS REFERENCE RELATED APPLICATIONS

This Application claims priority from U.S. Provisional Application Ser. No. 60/565,776 filed Apr. 27, 2004.

FIELD OF THE INVENTION

The present invention relates generally to the field of high strength and wear resistant tubes. The invention has particular utility in the field of gun barrels and to the formation of gun barrel liners providing improved wear performance, and it will be described in connection with such utility, although other utilities such as nozzles, slurry conduits, etc., are contemplated.

BACKGROUND OF THE INVENTION

It is well known that the wear of gun barrel inner surfaces has been exacerbated by the use of propellants with extremely high flame temperatures or in the case where very high energy projectiles are fired in rapid and long burst cycles. This has significantly limited the lifetime of conventional steel gun barrels to unacceptably short times, such that it is widely recognized that higher performance gun barrels are needed.

State-of-the-art gun barrels utilize electroplated chromium as a barrel liner or coating. The thin chromium electroplated coating is cracked and porous as deposited or becomes cracked and porous from the first few projectiles fired through the barrel. The cracked and porous chromium layer permits corrosive propellant gases to attack the underlying steel causing what is termed heat checking which causes the barrel to fail by wear, erosion, corrosion, and excessive fatigue of the steel. Such electroplated chromium steel barrels provide barrel lives of about 20,000 rounds; however, users have expressed a desire to extend barrel lives to 40,000 rounds, or more. In addition, Executive Order D013148 requires the phasing out of hexavalent chromium which is used to deposit chromium coatings on gun barrel bores and other applications.

One solution to improving barrel lifetimes is to substitute a more heat resistant and harder (i.e., more wear resistant) material which suggests either a refractory metal or a ceramic material. An additional requirement is that the liner be applied in a crack- and pore-free state. Due to the high pressures and thermal cycling associated with live firing and the fact that ceramics are inherently brittle, ceramics with fiber reinforcement or ceramic matrix composites (CMC) are preferred over monolithic ceramic materials. The prior art has proposed various gun barrels produced with liners formed of ceramic materials in compression, i.e. the condition in which ceramics are strongest. See, for example U.S. Pat. Nos. 4,401,729 and 5,125,179. Also, U.S. Pat. No. 5,348,598 describes a CMC gun barrel liner formed of a 3-dimensional fiber reinforced ceramic material.

The prior art also has proposed gun barrels with refractory metal coatings, produced usually by sputtering or chemical vapor deposition. See, for example U.S. Pat. Nos. 4,138,512, 4,577,431 and 4,669,212. However, such coatings have an abrupt interface, and are prone to spalling of the protective coating and are inherently brittle due to the physical properties of the deposited refractory metals.

Another limitation to current small caliber steel gun barrels is that they are heavy and cumbersome to carry. Substitution of the steel with a lighter weight metal such as titanium or a light weight metal matrix composite comprised of a lower density material would be a significant advancement for soldiers and law enforcement personnel.

For small caliber barrels in particular, it is extremely difficult to produce rifling in ceramic liners. In addition, such machining tends to fracture the fibers which in turn significantly degrades the mechanical properties.

SUMMARY OF THE INVENTION

The present invention provides novel high temperature and wear resistant ceramic matrix composite (CMC) gun barrel liners for gun barrels having a lightweight outer shell consisting of a metal matrix composite (MMC) or a high strength metal such as titanium. In the case of the CMC inner layer, the unique use of a mandrel with inverse rifling allows for the in-situ generation of rifling in the CMC layer. More particularly, the present invention in one aspect provides a CMC lined gun barrel with no distinct interface between the so-called liner and outer wrap. The fabrication of a CMC lined gun barrel in accordance with the first aspect of the invention entails essentially building the barrel from the inside to the outside, where a male mandrel with the lands and grooves that make up the rifling are machined into the mandrel surface. Uniaxial aligned fibers are then wound into the grooves followed by a variety of winding schemes for each layer of fibers that comprise the liner. For example, combinations of longitudinal, hoop, and angled wraps can be utilized in conjunction with the incremental densification of these layers using liquid preceramic polymers or chemical vapor infiltration. The mandrel is then removed by mechanical or chemical operation.

In another aspect the present invention provides novel refractory metal or metal alloy lined gun barrels, and methods for forming same and for assembling them into a barrel structure. In this latter aspect, the refractory metal or metal alloy liner can be formed by two different methods. One method involves machining a refractory metal or metal alloy rod or tube to the dimensions of the inner bore and including rifling. The other method involves forming the refractory alloy by plasma transferred arc solid free form fabrication (PTA SFFF). In PTA SFFF, metal powder(s) or a mixture of a metal powder or powders plus a ceramic powder or powders, is fed through a plasma transfer arc welding torch and deposited on the inner surface of a tubular metallic substrate. The position of the torch head is controlled by a multi-axis motion controller, such as a multi-axis CNC controller or a multi-axis robotic controller. The motion of the torch head is controlled so as to deposit 3-dimensional structures of the metal or metal-ceramic mixture on the inner surface of the tubular substrate. Alternatively, a wire feed can be used in place of the powder feed to deposit the desired material. In either case, there is no abrupt interface between the liner and the overwrap, which since it is deposited in the liquid state, will react with the liner to chemically bond the two components. Thus, one innovation of the present invention is the fabrication of a graded gun barrel, which gradually changes from a highly wear resistant bore to a high strength overwrap.

BRIEF DESCRIPTION OF THE DRAWINGS

Further features and advantages of the present invention will be seen from the following detailed description, taken in conjunction with the accompanying drawings, wherein like numerals depict like parts, and, wherein.

DETAILED DESCRIPTION OF PREFERRED EMBODIMENTS

Figure 1:
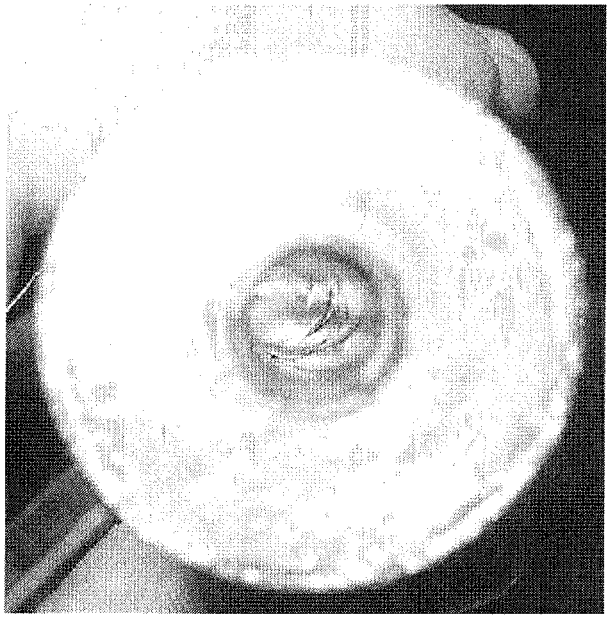
FIG. 1 is a cross-sectional view of a gun barrel made in accordance with a first embodiment of the invention.

Referring now in detail to the accompanying drawings, there is shown in FIG. 1, a tubular structure adopted for use as a gun barrel, designated at 10, and constructed in accordance with a first embodiment of the present invention. Gun barrel 10 comprises an inner ceramic matrix composite (CMC) liner 12 in an outer sleeve 14.

Figure 2:
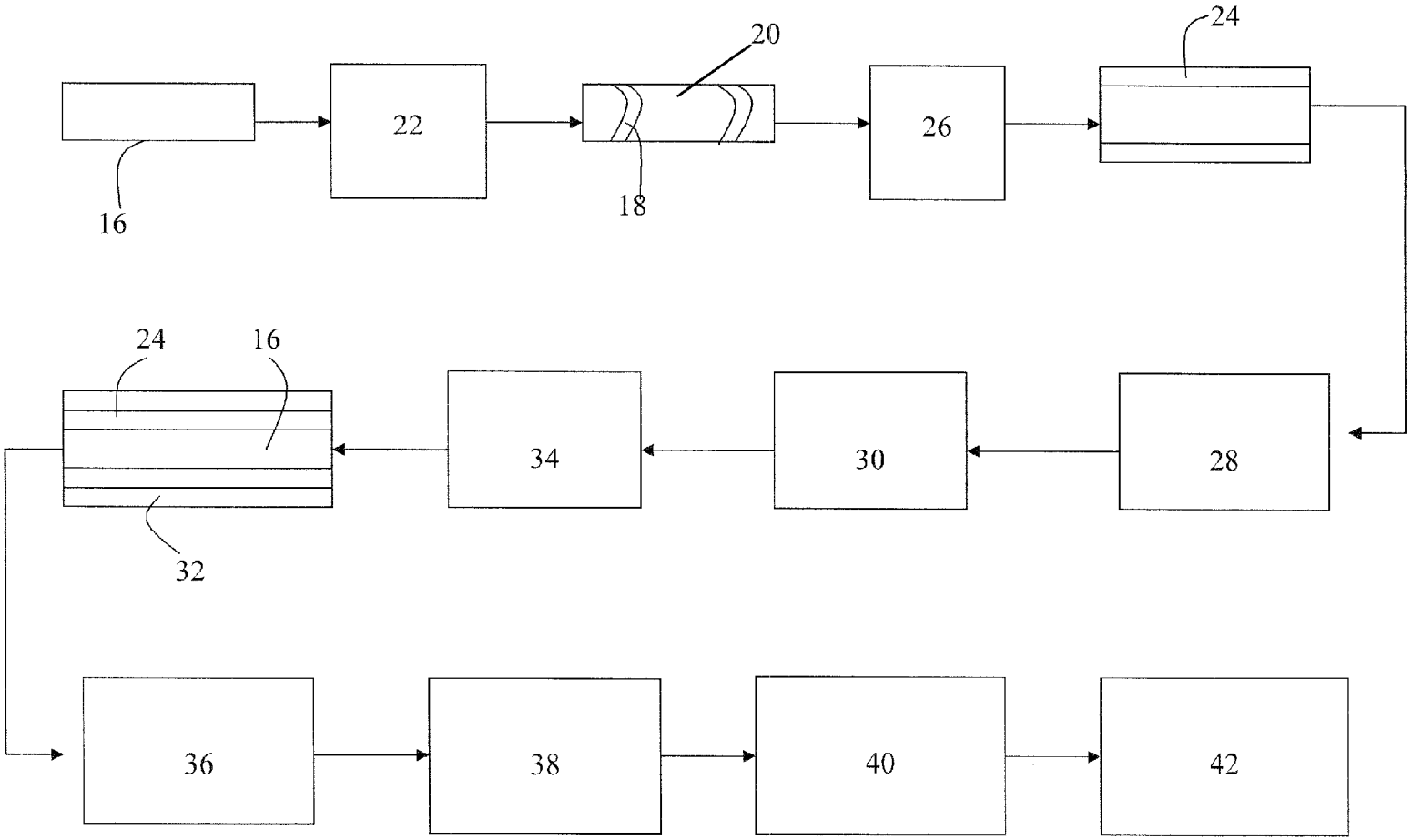
FIG. 2 is a block diagram showing the steps of fabricating a gun barrel of FIG. 1.

Referring also to FIG. 2, liner 12 is formed essentially by building the barrel from the inside to the outside starting with a male mandrel 16 in which the lands and grooves 18 and 20, which make up the barrel rifling are machined into the mandrel surface at a machining station 22. In a next step uniaxial aligned carbon or graphite, or silicon carbide (SiC) fibers 24 are wound onto the mandrel 16 in a winding station 26. Preferably a combination of longitudinal, hoop and angled wraps are deployed in winding station 26. The wrapped fibers are then infiltrated using either a liquid preceramic polymer such as SP Matrix available from Starfire Systems, Inc., Malta, N.Y. or by chemical vapor infiltration of, for example methyltrichlorosilane, dimethyldichlorosilane, or $SiCl_4$, which are given as exemplary, or at an infiltration station 28. The infiltrated fibers were then pyrolyzed in a densification station 30, and the resulting product was reinfiltrated and pyrolyzed for a plurality of additional cycles to build up a dense matrix comprising a carbon or graphite composite material. The resulting composite material was then overwrapped with alumina fibers 32 at a wrapping station 34 until a desired barrel diameter is achieved. The alumina fiber wrapped barrel is then placed in a die and squeeze cast in a pressure casting station 36. The pressure of the squeeze casting forces the aluminum into the alumina fibers and into the outer porous layers of the carbon or graphite composite liner material which provides a gradation in composition from a ceramic matrix composite (CMC) to a metal matrix composite (MMC).

After completing the squeeze casting, the outer surface of the product is machined to a desired OD at a machining station 38, while the graphite mandrel is removed by drilling and brushing at a mandrel removal station 40. The resulting barrel is then final machined and polished at a final machining station 42.

Figure 3:
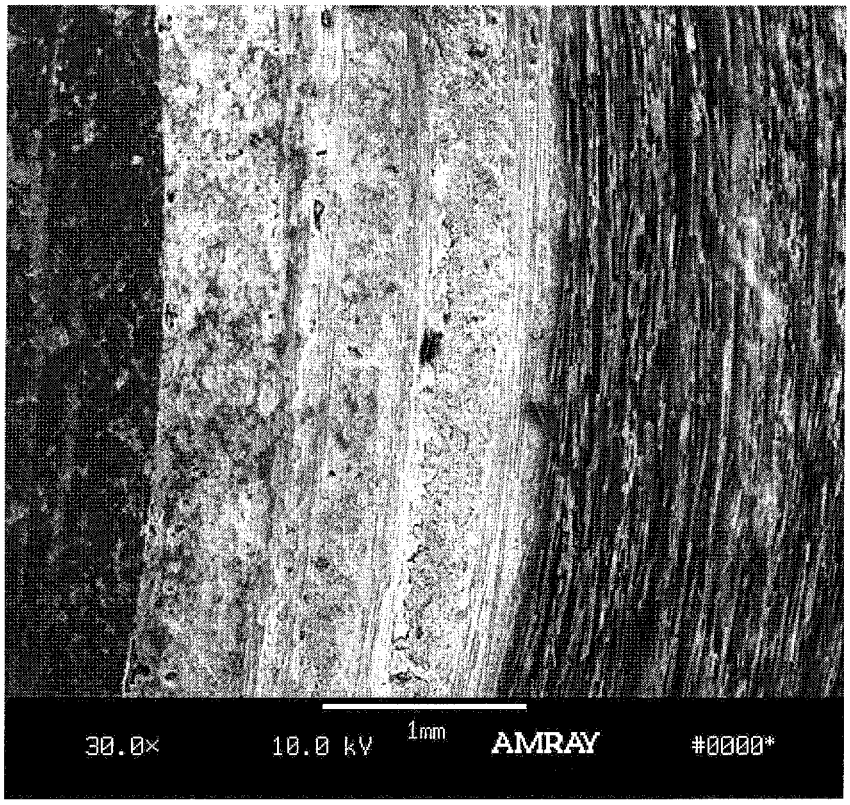
FIG. 3 is a photomicrograph showing the microstructure of a gun barrel of FIG. 1.

The resulting CMC liner has a microstructure as shown in FIG. 3.

Figure 4:
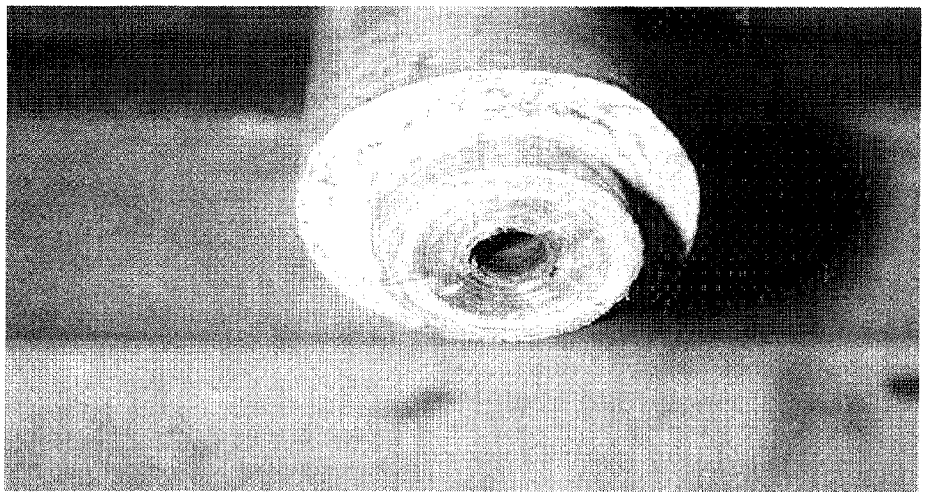
FIG. 4 is a cross sectional view of a gun barrel made in accordance with a second embodiment of the invention.
Figure 5:
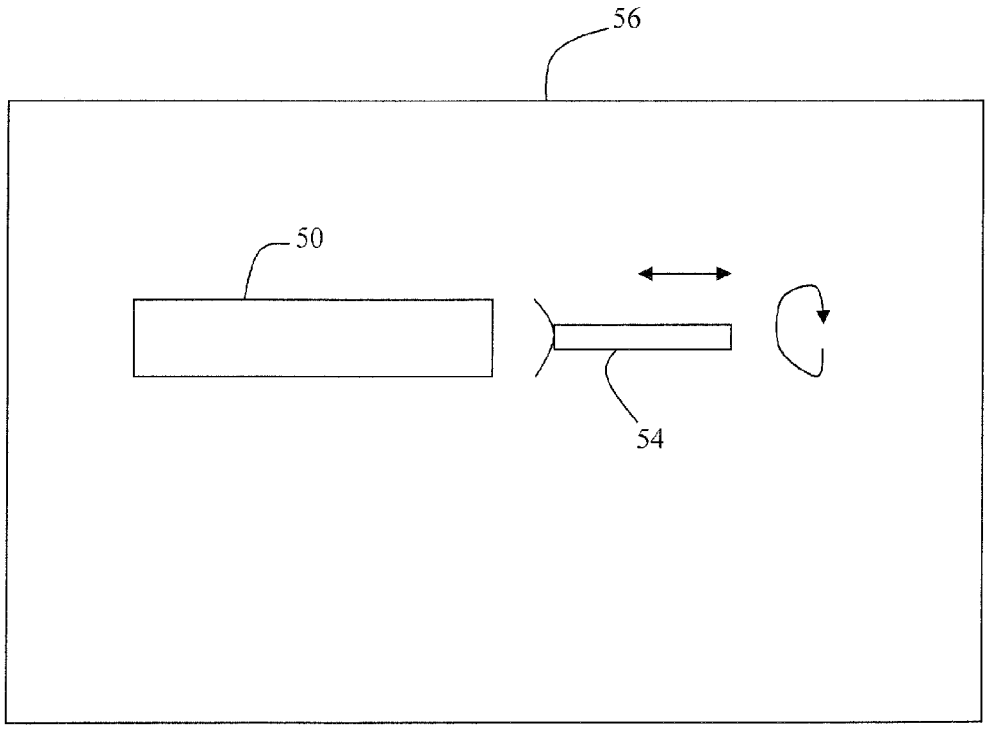
FIG. 5 is a schematic diagram showing the steps of fabricating a gun barrel of FIG. 4.
Figure 6:
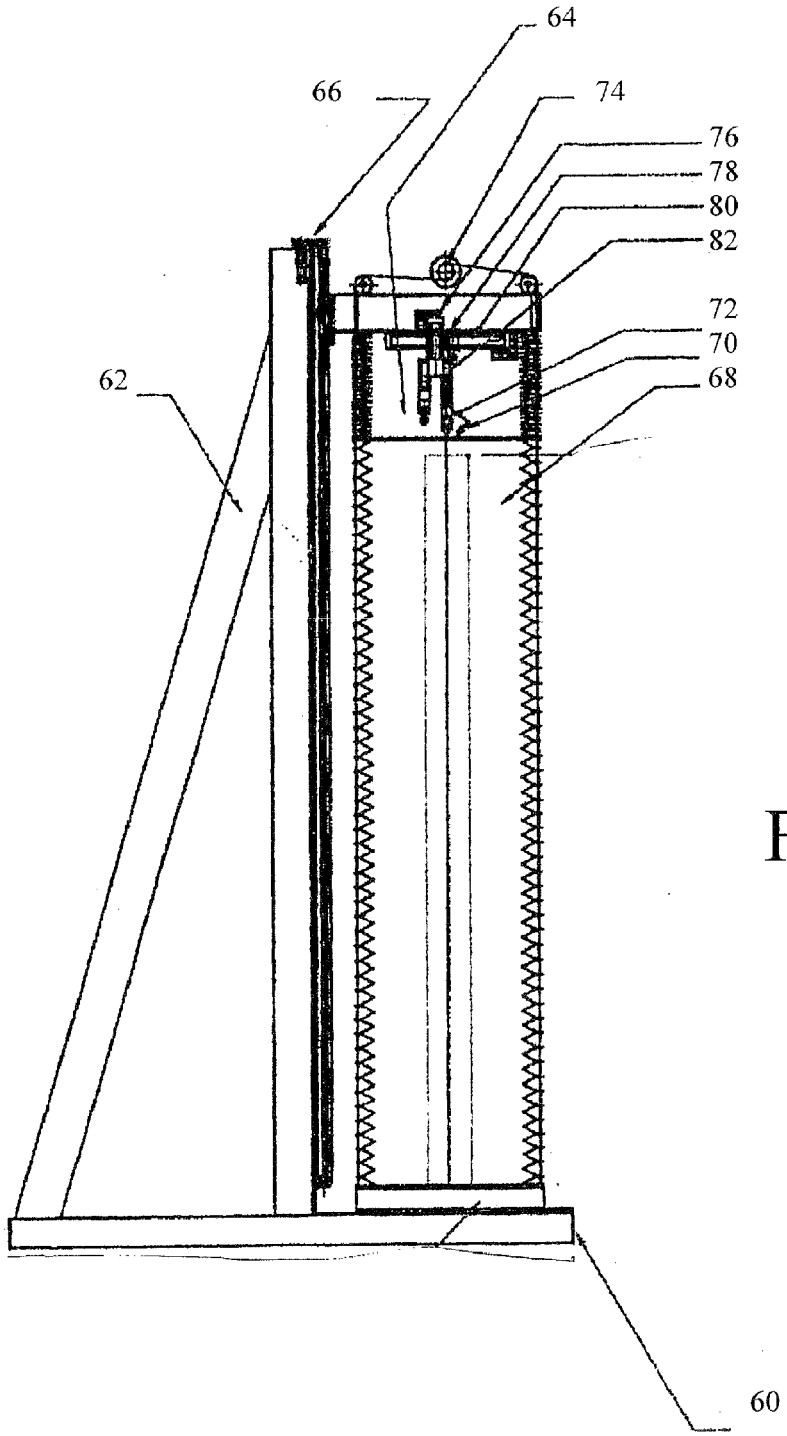
FIG. 6 is a side elevational view illustrating an apparatus useful for fabricating a gun barrel of FIG. 4.

Referring to FIGS. 4-6, there is shown an alternative embodiment of the invention. More particularly, in accordance with the alternative embodiment, a gun barrel is formed from the inside out, by depositing a three dimensional structure of a metal or metal ceramic 44 on the inside of an elongated outer shell 46. The outer shell may comprise steel, titanium or other metal or metal alloy suitable for forming the outer surface of the gun barrel.

Alternatively, the outer shell may comprise a pre-formed tube of a metal matrix composite such as alumina fiber reinforced aluminum. More particularly, a hollow metal tube 50 is provided, and a plasma coating torch 54 is placed at the end of the tube 50 at a coating station 56 so that the torch is free to travel inside the tube 50 while rotating relative to the tube. A metal alloy mixed with titanium powder is fed to the tube at coating station 56, and the torch advanced into the tube by plasma transferred arc solid free form fabrication (PTA SFFF).

Referring also to FIG. 6, there is illustrated an apparatus for fabricating a gun barrel in accordance with the present invention. The apparatus, which was manufactured by Arc Specialties of Houston, Tex., is based on the company's ARC-6 BORE CLADDER which is a four axis CNC controlled cladder. The apparatus includes a base 60 and frame 62 defining a closed welding station 64 supporting a servo-driven slide 66. A bellows 68 accommodates movement of slide 66.

A micro-plasma torch 70 is mounted for rotational and translational movement within the welding chamber for precisely welding the inner and outer walls of the tube 50. A camera 72 is carried adjacent the plasma torch 70 for permitting real time observation of the welding arc. The apparatus also includes a bellows take-up motor 74 and servo-driven slide 76, 78, 80 adjustment slides for permitting three axis adjustment of a high deposition torch 82 rotatably and translatably carried thereon. Conventional feeds, and the like, have been omitted for the sake of clarity.

The rate of rotational and translational travel of the torches were adjusted so that a continuous layer of the alloy mixture is deposited on the bore of the tube. Deposition is continued while the composition is varied, as desired, to build up a liner having a desired composition. Alloy compositions such as 50Ta-50Cr and many other special alloys that typically are not produced by traditional alloy fabrication may be formed, including but not limited to Ta—Cr—Mo, Ta—W, Nb—Cr, Mo—Re, Mo—W—Re, Mo—Ta—W. Additionally cermets of the above and other alloys which may include ceramic particulates in the refractory metal alloy readily may be produced by the PTA SFFF process.

The alloy as formed on the inside wall of the tube may or may not be functionally graded and may be formed with or without an interface liner to the outer tube or shell. In the event that there is an interface, the shell and/or the interface liner preferably will be threaded to provide mechanical interlocking such that the liner will not be expelled during live firing. Alternatively, rather than depositing the refractory metal or metal alloy on the inside wall of a tube, the metal or metal alloy can be applied to the outside surface of a rotating mandrel, built up to a desired thickness, and the mandrel removed, e.g., by machining and oxidation.

The invention will be further understood from the following non-limiting examples which are given as exemplary.

EXAMPLE 1

A graphite mandrel was machined with lands and grooves which replicate the rifling in a barrel. A silicon carbide (SiC) fiber (HI-NICALON available from COI Ceramics, Inc, San Diego, Calif.) was wound into the grooves of the graphite mandrel which was then overwrapped with a hoop layer of the SiC fiber. A SiC preceramic polymer (VL20 available from Kion Corporation, Huntington Valley, Pa.) was infiltrated into the SiC fiber wrappings and pyrolyzed to produce a SiC matrix. The preceramic polymer was reinfiltrated and pyrolyzed in five additional cycles to build up a dense SiC matrix.

Longitudinal SiC fibers (HI-NICALON available from CIO Ceramics, Inc.) were then wrapped around the SiC/SiC composite layer which was then followed by a hoop wrap and then ±22° wraps. A SiC preceramic polymer (VL20 available from Kion Corporation) was then reinfiltrated and pyrolyzed in five more cycles. Any number of fiber wrap layers in different architectures can be applied, and the SiC matrix produced from reinfiltrations and pyrolyses of liquid ceramic polymer. The outer most layers of SiC fibers are only infiltrated once to provide a porous outer layer to promote bonding to the outer shell.

After the CMC fabrication, the SiC/SiC composite liner is overwrapped with alumina fibers (Nextel 610 available from 3M Corporation, St. Paul, Minn.) until the desired barrel diameter is achieved. The fiber wrapped barrel is then placed in a steel die and aluminum squeeze cast at pressures up to 10,000 psi. The pressure of the squeeze casting forces the aluminum into the alumina fibers and into the outer porous layers of the SiC/SiC liner and provides a gradation in composition from the CMC to the MMC.

After completing the squeeze casting and initial machining, the mandrel is removed by drilling or oxidation. The barrel is then final machined and polished to provide a finished barrel.

EXAMPLE 2

The graphite mandrel is prepared as in Example 1, and after the initial SiC fiber winding, instead of using a preceramic polymer to form the SiC matrix, the SiC matrix is produced by chemical vapor infiltration (CVI) processing, by subjecting the graphite mandrel to CVI using methyltrichlorosilane and hydrogen in a CVI chamber heated to 1000° C. which produces a SiC matrix in the SiC fiber array. Additional layers of SiC fibers are then wound, and the SiC matrix produced either by CVI or the preceramic polymer. The MMC and final barrel preparation are performed by overwrapping with alumina, and squeeze casting as described in Example 1.

EXAMPLE 3

A steel tube mandrel was rotated with water flowing in its center, and a plasma transferred arc (PTA) system was used to deposit Ta-50Cr (% by weight) in a molten state on the outer surface of steel tube mandrel and built up layer by layer until the deposited thickness was 0.08". The Ta-50Cr was produced by feeding equal amounts of Ta and Cr powder to the arc pool. Following deposit of the Ta—Cr layer on the mandrel, a layer of about 0.040" thickness of pure tantalum was applied with a PTA system which was graded into pure titanium using a programmed computer controlled powder feed system to the PTA arc pool. This operation was carried out in an inert gas chamber with a continuous flow of Ar gas so as to maintain the oxygen content in the chamber at <100 ppm. In this manner a titanium structure was built up for the barrel. The pure Ta layer was produced to avoid any brittle intermetallic formation with the titanium.

After building the titanium layer, the steel mandrel tube was drilled out by electrical discharge machining (EDM). After the steel mandrel is removed, the rifling is formed by hammer forging or by broaching or by plunge EDM or by electrochemical machining (ECM). The refractory metal lined barrel after rifling is machined and fitted into a weapon.

EXAMPLE 4

The refractory metal liner was formed as in Example 3, but after the liner was formed, it was wrapped with alumina fiber and squeeze cast with aluminum as in Example 1.

EXAMPLE 5

The refractory metal liner was formed as in Example 3 except that titanium carbide particulates were fed together with the Ta—Cr powder to produce a refractory metal cermet liner. The barrel outer structure was formed from titanium as in Example 3.

EXAMPLE 6

The refractory metal liner was formed as in Example 3 except that steel was used rather than titanium to build up the barrel.

EXAMPLE 7

A tube with a 5" ID was set on a fixture to rotate at a constant speed. A plasma transferred arc bore coating torch was placed at the end of a steel rod so that it was free to travel inside the Ti tube. The steel rod with the torch was attached to a single axis motion controller such that the steel rod and torch could be moved at a constant speed within the rotating tube along the long axis of the tube. A mixture of Ta-50Cr (% by weight) was mixed with Ti powder to provide a composition with 75% by weight Ti and 25% by weight Ta-50Cr. The rate of rotation and torch travel were adjusted so that a continuous layer of the mixture was deposited on the bore of the Ti tube. This was repeated with a second deposition layer of 50% by weight Ti with 50% by weight Ta-50Cr, followed by a third layer of 25% by weight Ti and 75% by weight Ta-50Cr, and finally a layer of 100% Ta-50Cr. An Ar gas flow was maintained in the tube to keep the oxygen level below 100 ppm throughout the deposition.

EXAMPLE 8

A refractory metal liner was formed as in Example 3 except that the titanium tube was replaced a steel tube, and AerMet® 100 alloy steel powder (available from Carpenter Specialty Alloys, Reading, Pa.) was used rather than the titanium powder to form the graded layers with Ta-50Cr.

Thus, the present invention provides gun barrel liners consisting of refractory metals, refractory metal alloys, refractory metal cermets, or a CMC having high temperature and wear resistance capabilities, low weight and high strength. The gun barrels may be made from titanium, which is approximately 42% lighter than steel, or alternative metals or metal alloys such as aluminum as a barrel structure. The latter can be accomplished by using a PTA SFFF process to build the barrel up from the inside out, or by coating the ID of a prefabricated barrel. And, PTA SFFF deposited refractory lined steel gun barrels made in accordance with the present invention have substantially enhanced performance compared to conventionally lined steel gun barrels. Thus, the invention provides for production of a wear resistant liner with a subtle gradation in composition to the high strength overwrap, with no distinct interface between the liner and the overwrap.

Hoop or burst strength measurements have been performed on hollow MMC cylinders made in accordance with the present invention. The hoop strength was as high as 839 MPa (122 ksi), which far exceeds the pressures experienced in small caliber barrels. The final composite barrel is approximately 50% lighter than an all-steel barrel depending on the thickness of the outer shell and ultimate composition.

Various changes may be made in the above invention. For example, various combinations of CMCs, refractory metal or metal alloys, and MMCs may be employed with various ceramic particles in forming barrel structures of titanium, other suitable metals or metal alloys, or MMC, or if weight is not of issue a steel barrel structure formed by a PTA process. Such combinations are covered by the spirit of this invention.

What is claimed is:

1. A high strength heat and wear resistant tube comprising an outer shell lined with a ceramic matrix composite material, wherein the ceramic matrix composite material consists of aligned carbon, graphite, or silicon carbide fibers; and wherein the matrix composite material is formed by building outward from a mandrel by fiber wrapping and infiltration/pyrolysis to form the matrix.

2. A high strength wear resistant tube as claimed in claim 1, wherein the liner comprises a refractory metal or metal alloy.

3. The high strength wear resistant tube as claimed in claim 2, wherein the liner is graded in composition from lower porosity at the bore to a higher porosity adjacent its outer diameter.

4. The high strength wear resistant tube as claimed in claim 2, wherein the liner comprises a refractory metal or metal alloy liner containing ceramic particulates.

5. A firearm barrel comprising a high strength wear resistant tube as claimed in claim 1.

6. A firearm barrel as claimed in claim 5, wherein the ceramic matrix composite material lining the outer shell inner surface is rifled.

7. The firearm barrel as claimed in claim 5, wherein the outer tube comprises a metal selected from the group consisting of steel, titanium and aluminum.

8. A firearm barrel comprising an outer tube having a wear and heat resistant liner, wherein the wear resistant liner consists of a formed in-situ material which is graded in composition from a lower porosity at the bore to a higher porosity at the outer diameter.

9. A firearm barrel as claimed in claim 8, wherein the liner comprises a ceramic matrix composite.

10. A firearm barrel as claimed in claim 8, wherein the liner comprises a refractory metal or metal alloy.

11. A firearm barrel as claimed in claim 8, wherein the liner has a bore with rifling formed in-situ.

12. A firearm barrel as claimed in claim 10, wherein the refractory metal or metal alloy is selected from the group consisting of Ta—Cr, Ta—Cr—Mo, Ta—W, Nb—Cr, Mo—Re, Mo—W—Re and Mo—Ta—W.

13. A firearm barrel as claimed in claim 10, wherein the refractory metal or metal alloy liner is formed in-situ by plasma transfer arc processing.

14. A firearm barrel as claimed in claim 8, wherein the outer tube comprises a metal selected from the group consisting of steel, titanium or aluminum.

15. A firearm barrel comprising an outer tube having a wear and heat resistant liner, wherein the wear resistant liner comprises a ceramic matrix composite having a bore with rifling formed in-situ and wherein the ceramic matrix composite material consists of aligned carbon, graphite, or silicon carbide fibers.

16. A high strength heat and wear resistant tube comprising an outer shell lined with a ceramic matrix composite material wherein the ceramic matrix composite material consists of aligned carbon, graphite, or silicon carbide fibers, a refractory metal, a refracting metal alloy or a refractory metal cermet, having a metal matrix composite overwrap.

17. A firearm barrel formed from the high strength heat and wear resistant tube as claimed in claim 16.

18. A firearm as claimed in claim 17, wherein the liner comprises refractory metal or metal alloy liner containing ceramic particulates.

19. A firearm barrel as claimed in claim 17, wherein the liner inner surface is rifled.

20. A firearm barrel comprising as claimed in claim 19, wherein the rifling is formed in-situ.

21. A firearm barrel as claimed in claim 17, wherein the refractory metal or metal alloy is selected from the group consisting of Ta—Cr, Ta—Cr—Mo, Ta—W, Nb—Cr, Mo—Re, Mo—W—Re and Mo—Ta—W.

22. A firearm barrel as claimed in claim 17, wherein the refractory metal or metal alloy liner is formed in-situ by plasma transfer arc processing.

23. A firearm barrel as claimed in claim 17, wherein the metal matrix composite overwrap comprises a metal selected from the group consisting of steel, titanium or aluminum.

24. A firearm barrel as claimed in claim 17, wherein the liner has a lower porosity adjacent its bore to a higher porosity adjacent its overwrap.

* * * * *